United States Patent [19]

Raven, III

[11] 4,423,567

[45] Jan. 3, 1984

[54] POWER STROKING HONING MACHINE AND CONTROL APPARATUS

[76] Inventor: Alfred J. Raven, III, 7 Hillside Ter., Morganville, N.J. 07751

[21] Appl. No.: 302,489

[22] Filed: Sep. 16, 1981

[51] Int. Cl.[3] ..... B24B 5/08

[52] U.S. Cl. ..... 51/31 R; 51/345; 51/165.9; 51/165.91

[58] Field of Search ..... 51/34 R, 34 J, 165.9, 51/165.91; 91/275, 361

[56] References Cited

U.S. PATENT DOCUMENTS

| | | | |
|---|---|---|---|
| 4,173,847 | 11/1979 | Gehring et al. | 51/34 J |
| 4,176,586 | 12/1979 | Stoll et al. | 91/275 X |
| 4,189,871 | 2/1980 | Rottler et al. | 51/34 J |

FOREIGN PATENT DOCUMENTS

| | | | |
|---|---|---|---|
| 2370907 | 11/1977 | France | 91/275 |

*Primary Examiner*—E. R. Kazenske
*Assistant Examiner*—W. Fridie
*Attorney, Agent, or Firm*—Arthur L. Plevy

[57] ABSTRACT

A beam stroker honing machine is controlled to provide a vertical stroke by means of a series of non-contacting sensors. The sensors are a plurality of reed switches which sense the position of a hydraulic cylinder which moves the honing beam up and down. The switches are operated by a magnetic piston associated with the cylinder and by selecting a switch the length of the stroke can be changed during machine operation. The honing machine also provides a power dwell operation which allows the honing tool to remain and reciprocate over a small distance at the bottom of the cylinder being honed for selectable period of time. After power dwell operation the honing machine is returned to its normal vertical stroke selected as above described.

8 Claims, 4 Drawing Figures

POWER STROKING HONING MACHINE AND CONTROL APPARATUS

BACKGROUND OF INVENTION

This invention relates to a honing machine and more particularly to a honing machine having an automatic predetermined power stroke with the further ability to provide a predetermined dwell at the bottom of the stroke for honing cylindrical surfaces such as the bores in engine blocks.

The prior art is replete with a number of honing machines for finishing rebored engine blocks. Such machines, even those employed in small repair and maintainence shops are relatively expensive and complicated.

In general honing machines operate to provide a rotational motion to the honing tool coupled with an oscillatory motion in the vertical plane. The oscillatory motion determines the length of the stroke and is a function of the type of cylinder to be bored. In order to accomodate various cylinders and engines and to further accomodate various other problems, the prior art recognized a need for controlling the vertical motion or stroke of the machine.

Therefore in such machines one employed adjustable upper and lower limits of travel. The adjustments of the upper and lower travel limits are accomplished by mechanical means which once set could not be easily changed or varied without stopping the honing machine and providing the changes. This severally limits the use of the machine as any change requires significant operation time. A typical prior art technique is depicted in U.S. Pat. No. 4,189,871 entitled HONING MACHINE issued on Feb. 26, 1980 to D. B. Rottler, et al.

This patent depicts a beam stroker honing machine having variable travel limits, which unit moveably mounted on first and second rods and adjustable by mechanically moving and locking the the same on the rods.

In this unit as in other units each time the stroke is changed the machine must be stopped to afford the appropriate adjustment. Other prior art machines employ an eccentric mechanical member which controls the vertical distance of the stroke. This mechanism also requires frequent stopping of the machine to enable the operator to make the necessary adjustments. The procedures involved in making the mechanical adjustments necessitated by the prior art honing machines greatly lengthens the time it would normally take an operator to hone a piece of material. Hence the end result is to significantly increase the costs to the consumer for such engine repair or refittings.

This obvious factor is coupled with the additional factor that the mechanical adjustments are subjected to excessive wear caused by constant manipulation and contacting by both the operator and the honing machine parts.

The control of the vertical stroke is accomplished in this invention by a non-contacting sensor array which operates in conjunction with a unique control assembly for automatically controlling the stroke.

Accordingly in this machine the length of the stroke can be changed as the machine is running and hence all the above problems are eliminated.

The apparatus to be described further solves another problem which is attendant with tapered cylinders.

Cylinders, of the type that are utilized in reciprocating gasoline engines, air compressors, and the like are generally designed such that the lower region or bottom of the cylinder has a narrower diameter than that in the central and upper regions. This manifestation of tapered cylinders is particularly evident in cylinders that are being re-bored, such as that on gasoline engines that have been utilized for a considerable amount of time. The process creating a tapered cylinder occurs as a result of normal wear in the cylinder taking place in the region of the piston rings, (in the region that the piston rings move). Illustratedly, in a cylinder, the portion of the piston housing the rings moves through perhaps 60% of the cylinder. The remaining portion of the cylinder, therefore, receives relatively little wear in comparison to that region in which the rings have retraveled. Resultingly, after a considerable length of time in reciprocating motion the upper region or region where the rings have moved in the cylinder becomes greatly enlarged in comparison to the remaining portion. In general, cylinders of newly manufactured engines are bored such that the diameter of the cylinder throughout its length is uniform. After the cylinder has been bored to a uniform diameter it is thereafter honed to a final diameter with a cross-hatched pattern. This cross-hatched pattern is for purposes of controlling the oil flow within the cylinder region.

Cylinders that require rehoning are typically out of round in cross-section and tapered from the lower region to the upper region causing a variation in cylinder diameter.

To provide the necessary honing in the bottom of the cylinder, it is necessary to periodically operate the honing tool such that it spends its maximum time in those portions having the narrower diameter, as well as operating in the regions with the greater diameter, but non-circular cross-sectional shape.

In other Honing Systems a feature is provided which allows the honing stone to go to a position near the bottom of the cylinder and remain there for a relatively short period of time. During this short period of time, the honing tool remains in the same vertical plane and rotates in an effort to increase the size of the cylinder where it is tapered the most. The problem that results from maintaining the hone in this position is that the honing tools will glaze after a relatively short period of time, resulting in chatter occurring and loss of cross-hatch in the resultant region. For this reason, on existing machines, the period of time in which the honing tool will dwell in one region is limited to a very few seconds (1 to 2 for example).

The problems set forth in the prior art machines are overcome by this invention by providing apparatus for causing the honing tool to dwell in an oscillatory mode over a relatively low amplitude cycle in the tapered region of the cylinder and to do so for any reasonable period necessary to properly hone the cylinder.

BRIEF DESCRIPTION OF THE PREFERRED EMBODIMENT

The honing machine is of the type which has a base assembly. A honing beam is pivotally mounted for vertical movement on the base assembly and actuating means coupled to the beam for moving the beam up and down in the vertical plane. A rotatable honing tool assembly is coupled to the beam. In combination is apparatus for controlling the movement of the beam between a given down position and a selectable up position. The apparatus includes a plurality of non-contacting sensors such as reed switches which are positioned along the vertical plane to detect any one of a number of vertical positions of the beam. Selector means are coupled to the sensors and operative to select any one of the plurality of sensors to provide a signal indicative of a desired vertical upper limit as defined by said selected sensor. Logic means coupled to the actuating means move the beam down upon receipt of said signal. In a second mode of operation there is a power dwell circuit which causes the beam to move between first and second limits defined by first and second sensors. The limits as provided cause the beam to move a short distance in the vertical plane and to exhibit an oscillatory motion between the limits. This motion is continued according to a selectable time interval which is selected via a timing control means coupled to the power dwell circuit.

DETAILED DESCRIPTION OF THE FIGURES

Figure 1:
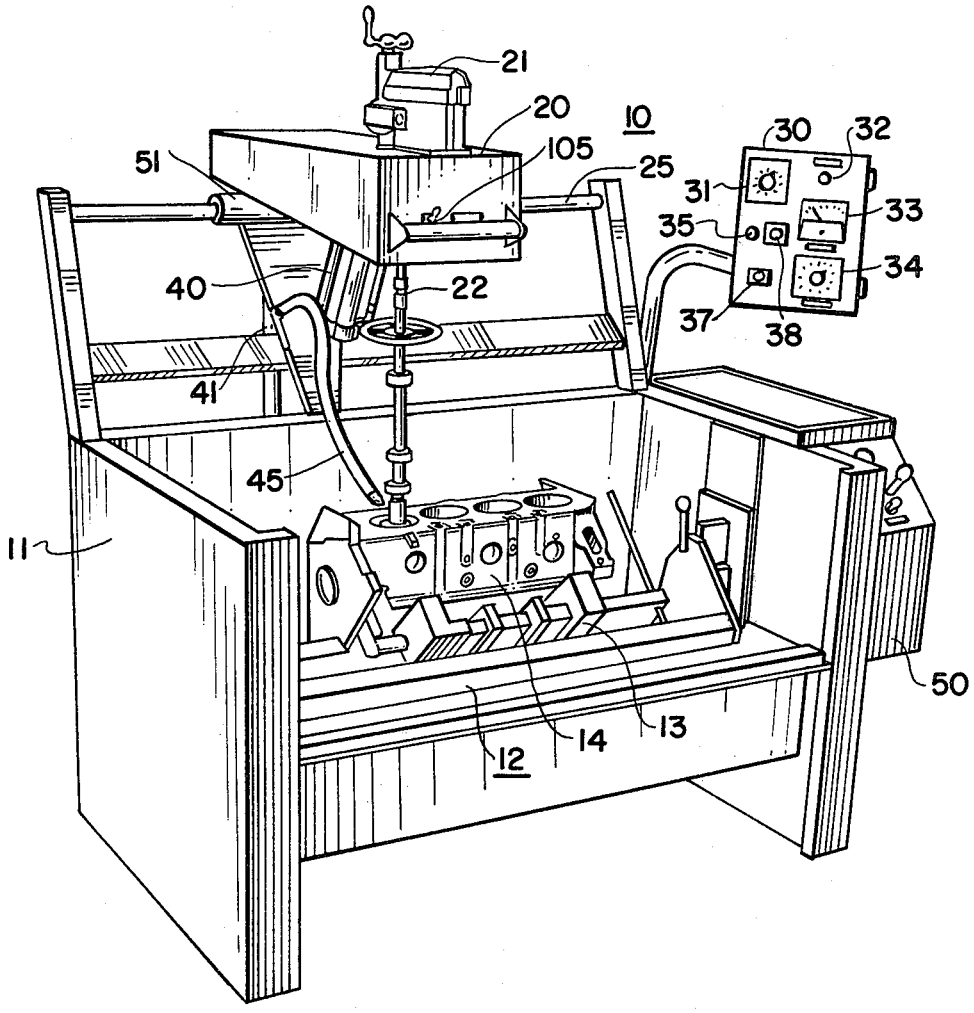
FIG. 1 is a perspective plan view of the honing machine according to this invention.

Referring to FIG. 1, there is shown a honing machine 10. The honing machine to be described is known as a beam stroker type of machine an example of which is shown in U.S. Pat. No. 4,189,871.

The honing machine comprises a stationary bed 11 which has a central area 12 which is a work deck. The area 12 includes a suitable clamping means as 13 which is a vise like structure adapted to hold an engine block 14 in a fixed position. The work deck area 12 is well-known in honing machines and there are many techniques known to the prior art for anchoring and holding an engine block as 14 in a fixed position with respect the honing tool.

Shown positioned above the work deck 12 is a pivotable beam 20. The beam 20 is pivotally mounted with respect to the stationary bed 11 and can pivot in the vertical plane as will be explained.

Coupled to the beam there is shown a motor 21 which engages a universal drive mechanism to rotate a honing tool 22. The tool 22 contains a honing head many examples of which are well-known in the art. Conventionally the honing head of tool 22 is emplaced within the cylinder to be machined. The beam 20 can also move in the horizontal direction along rod 25 to thereby enable the head of the honing tool to be emplaced in each cylinder associated with the engine block. As will be explained, the honing machine operates to cause the beam 20 to oscillate in the vertical plane and therefore to move the honing head along the length of the cylinder. At the same time the honing head is rotated by means of motor 21 to hone the cylinder as required.

Also depicted in FIG. 1 is a control panel 30. As will be explained the control panel 30 contains a first switch 31 which is designated as a Select-A-Stroke switch. As will be explained, the switch 31 enables the operator to automatically select the upper limit of the vertical stroke. In this manner, by setting the switch 31 the operator can change the vertical stroke or the movement of the beam in the vertical direction during machine operation. The control panel also contains a lamp 32 which provides a visual indication to the operator designating that the honing head is at the bottom of the cylinder. Also included is a meter 33 which monitors the amount of current or the load that the unit is operating at. Also shown is a timer 34 which operates to control the amount of time that the honing machine operates in a power dwell mode as will be explained.

The control panel also includes a power dwell switch 35 to enable one to select the power dwell mode. Also shown is a function switch 37 which causes the unit to be placed in operation together with a start switch 38. The vertical motion of the beam is controlled by a hydraulic cylinder 40. The cylinder 40 has one end coupled to the beam and the piston of the cylinder is coupled to a stationary support plate 41 which is secured to the machine bed 11. As will be explained, as the piston is extended, the honing beam 20 is moved up. When the piston is retracted, the beam is moved down. The up and down motion of the beam is monitored by a series of reed switches which are located about the periphery of the cylinder 40. As will be explained, the switches are mounted in a module in close proximity to the cylinder 40. The cylinder 40 contains a piston which has a magnetic head. Thus, as the head of the piston moves, the magnetic field closes or activates the reed switches. As will be explained, the activation of a selected reed switch causes the control logic to move the beam downwardly after a desired upper limit as selected by switch 31 has been achieved. The hydraulic cylinder 40 is controlled in the up and down directions by means of associated air over oil cylinders which are in turn controlled by solenoids to cause the beam to move up and down through the desired and selectable vertical distance which distance manifests a vertical operating storke.

The honing machine also has a power dwell mode which enables the operator to automatically cause the honing tool to dwell at the bottom of the cylinder to be machined for a predetermined time. This operation referred to as power dwell causes the honing head to move through or oscillate through a small distance in the vertical plane. Thus, in the power dwell mode the honing tool reciprocates at the bottom of the cylinder oscillating through a distance of about a ½" for a selectable period. At the end of the power dwell period the machine automatically returns to the selectable vertical stroke. As indicated, the power stroke dwell or power dwell feature is particularly advantageous when operating with tapered cylinders.

In any event, the honing machine 10 of FIG. 1 provides other conventional features which are found on prior art machines and which are not considered to be a part of the invention. Also shown in FIG. 1 is a hose 45 which ejects honing oil into the machine block during a machine operation. This is well-known and is used to lubricate the engine block and the honing tool during operation.

As will be further explained, the stroking speed or the speed at which the beam moves up and down is also controlled by means of needle valves and a pressure regulator as will be explained. The components are accessable via the control box 50 shown in FIG. 1.

Figure 2:
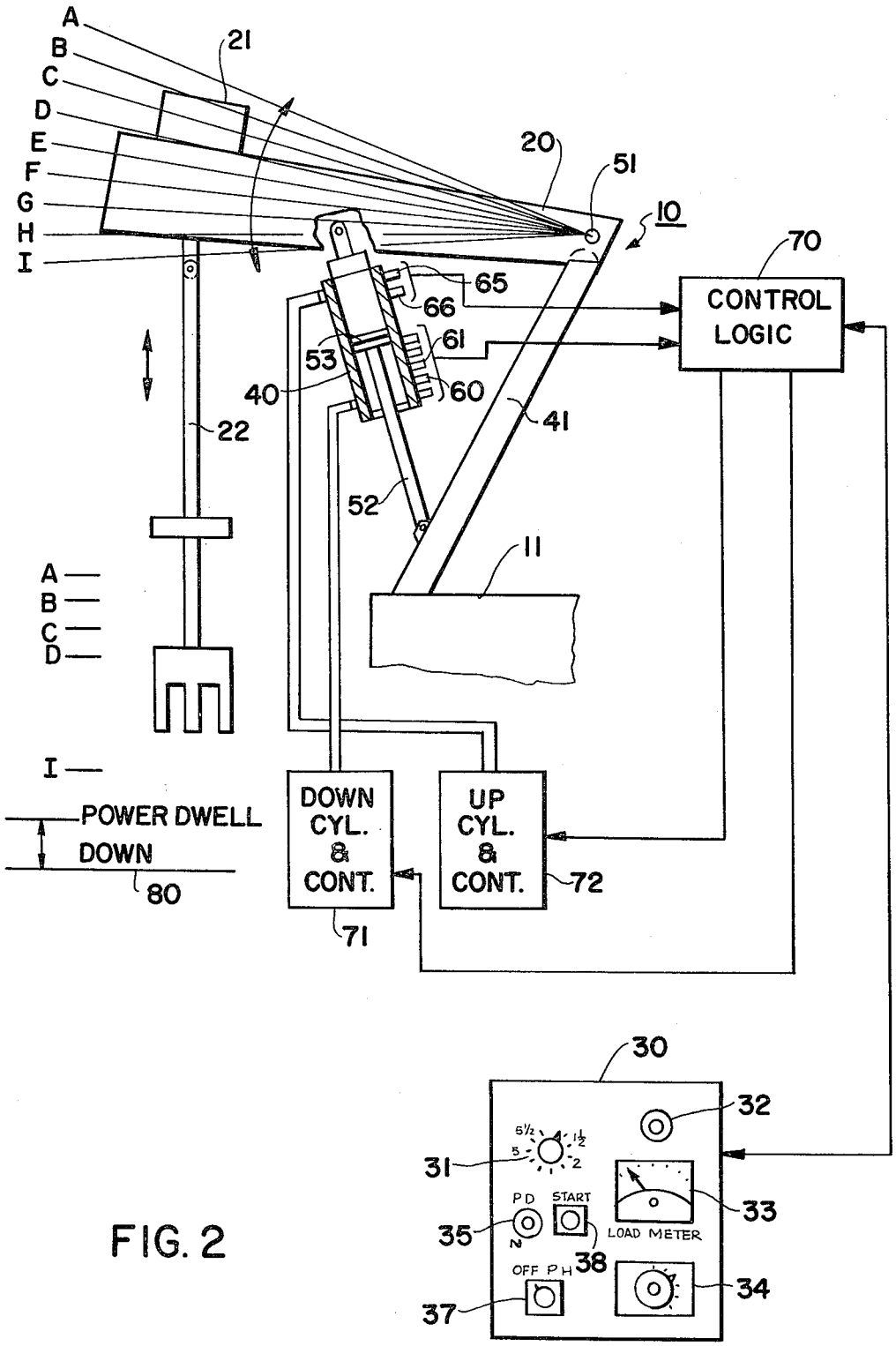
FIG. 2 is a simplified diagramatic view of the honing machine operation.

Referring to FIG. 2, there is shown a simple schematic diagram of the honing machine 10. The angular member 41 is secured to the base assembly 11 of the honing machine. The beam 20 is pivotally mounted on member 41 by means of a pivot point 51. Coupled between the beam 20 and the vertical support 41 is a hydraulic cylinder assembly 52. The head 53 of the piston is magnetic and is capable of producing a field of a sufficient intensity to actuate a series of magnetic reed switches which are aligned along the main access of the cylinder 40.

Thus in FIG. 2 the reed switches as 60 and 61 are positioned such that they designate or correspond to a predetermined upper limit of travel for the beam. Similarly, switches as 65 and 66 are positioned with respect to the cylinder 40 such that they correspond to the down position or lower limit of travel of the beam. Reed switches which respond to a magnetic field to cause contact closure are commercially available and have been employed in many applications such as in telephony and other systems as well. The switches as 60 are wired to a control logic unit 70 which is associated with the control panel 30.

As can be seen from FIG. 2, the cylinder 40 and the associated piston 52 are operable in an up or a down mode by means of a down cylinder and control circuit 71 and an up cylinder and control circuit 72. As will be explained, each cylinder is associated with a solenoid which in turn is controlled by the control logic to automatically reverse direction of the beam when a selected path is traversed. The cylinders 71 and 72 are air over oil cylinders or tanks and hence operate with both air and fluid pressure. Such cylinders are well-known in the art and have been used for many purposes. As indicated in FIG. 2 the selector switch 31 on control panel 30 enables the operator to automatically select the maximum vertical height that the beam will travel during the power stroke. The graduations are shown in FIG. 2 as A through I and represent the upper limits that the beam will travel as selected by switch 31.

In a typical machine the maximum upper limit A defines a $5\frac{1}{2}''$ stroke while the lower limit I gives a $1\frac{1}{2}''$ stroke. Each stroke as B, C and so on differs from the succeeding or preceeding stroke by a $\frac{1}{2}''$. Thus B will give a stroke of 5" and H a stroke of 2". It is of course immediately understood that each stroke selected is associated with a separate reed switch positioned adjacent the cylinder 40 and operated by the piston as it travels. The switch as 60 is located such that the upper limit is selected and determined by the location of the switch as 60. In this manner one can position the switches in any spacing and any arrangement desired to give any stroke within the limits of beam operation.

The upper limit as A through I of each stroke as selected by switch 31 is referenced to the down position of the honing head of tool 22 which is shown in FIG. 2 as a down reference line 80. Thus for example, the distance that the honing head moves from position I to the down position 80 is $1\frac{1}{2}''$ and the distance moved from position A to the down position is $5\frac{1}{2}''$. Once the switch 31 is set the honing tool 22 will move from the down position to the upper limit specified by switch 31 and designated by a reed switch as 60. Once the piston head activates the selected reed switch during the up movement of the beam as controlled by the cylinder 40, the direction of movement is automatically reversed and the down cylinder 71 is activated. Thus the honing head after reaching the upper position as selected will now move back towards the down position. The maximum down movement is also sensed by reed switches as 65 and 66 as will be explained. Hence, when the head of the honing tool 22 is in the maximum down position, the reed switches as 65 will again reverse direction by activating the up cylinder 72 via the control logic 70. The speed in the up and down positions is controlled by means of needle valves and a pressure regulator as will be explained.

It is noticed that the reed switches in conjunction with the magnetic piston are non-contacting sensors. In this manner there is no physical contact made between these sensors and the machine body and therefore operation is both reliable and extremely accurate. Also shown in the diagramatic view of FIG. 2 is a line located above the down line 80 designated as power dwell. This operation occurs by moving switch 35 to the power dwell (PD) position. In this position the honing head moves from the down position to the power dwell position which may constitute a movement of $\frac{1}{2}''$ at the bottom of the stroke. This distance for power dwell is determined by two reed switches as 65 and 66 corresponding to the bottom of the stroke and located to allow a movement of $\frac{1}{2}''$ in the vertical plane. The length of time for power dwell is selected by means of the timer 34 located at the control panel 30. After the interval selected by timer 34 elapses, the unit is automatically placed back into normal operation where the beam traverses the vertical path as selected by switch 31.

Figure 3:
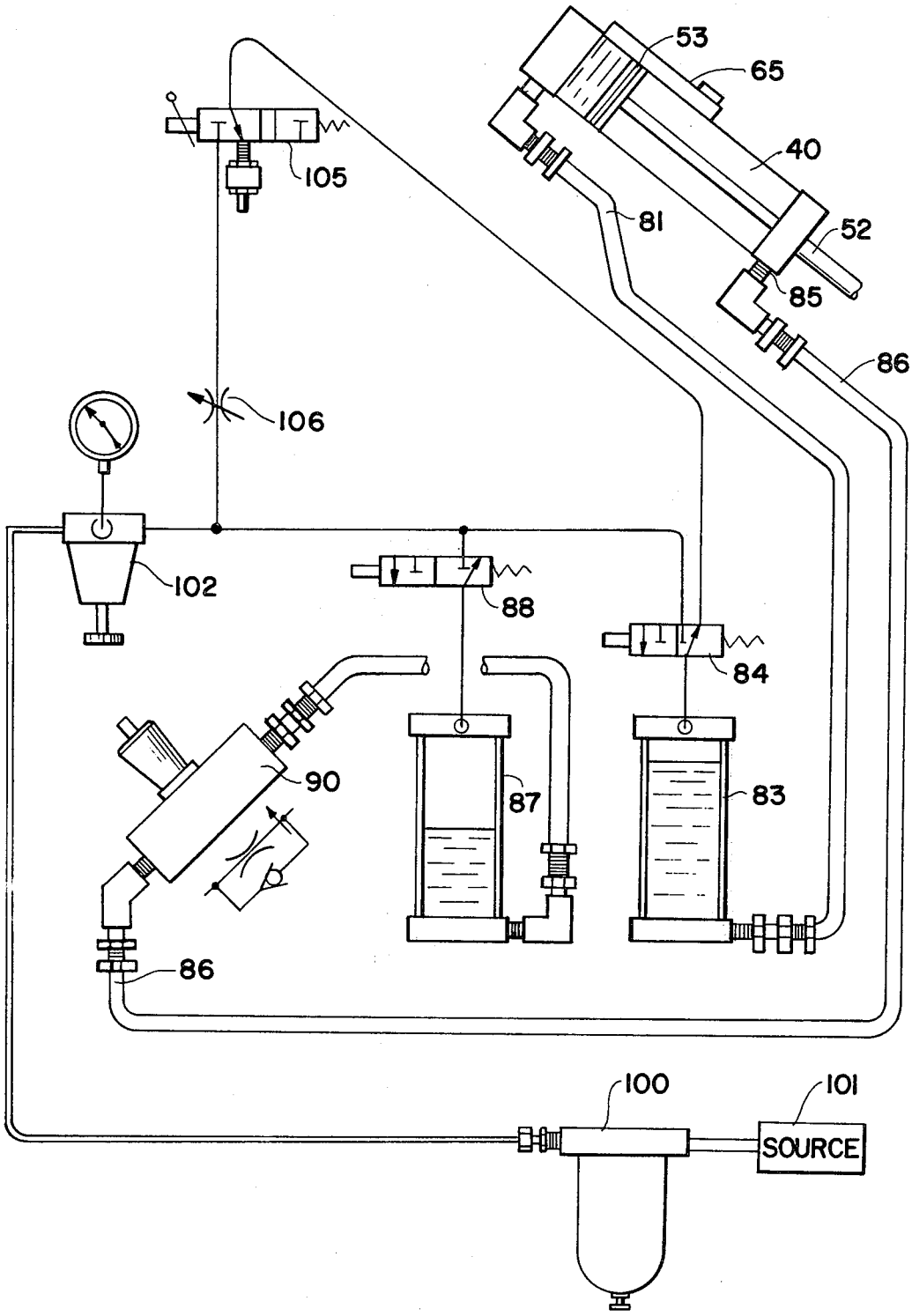
FIG. 3 is a schematic diagram of a hydraulic and pneumatic system used in this invention.

Referring to FIG. 3, there is shown a hydraulic and pneumatic schematic showing control and operation of the hydraulic cylinder 40. The cylinder 40 has an up control port 80 to which is coupled a hydraulic hose 81 directed to an air oil tank 83 which is operated by means of a solenoid 84. A down control port 85 is coupled to a flexible hose 86 and directed to a down control air over oil cylinder 87. The cylinder 87 is controlled by an associated solenoid 88. Coupled in series with the tubing 86 is a flow control valve 90. The valve 90 operates to control the down speed of the honing beam. The up and down stroking of the beam is controlled by hydraulic oil in cylinders 83 and 87 which hydraulic oil is alternately pressurized with compressed air directed through the air filter 100 which is coupled to a source of pressurized air 101 and directed through a pressure regulator 102 and thence through the solenoids 84 and 88 to the respective tanks 83 and 87.

Also shown is a separate valve 105 and a needle valve 106 which can enable one to separately raise the beam as desired. The up speed of the beam is controlled by the pressure regulator 102 while the down speed is controlled by the flow control valve 90. The valve 105 has an up position which moves the beam to the full up by pressurizing the air oil tank 83. The down position is also accomplished with valve 105 in the down position which exhausts the tank 83 to cause the beam to lower due to the force of gravity. As can be seen, operation of solenoid 84 causes the beam to move upward while operation of solenoid 88 causes the beam to move downward. The full up and full down position as controlled by valve 105 are located on the beam 20 of FIG. 1. The pressure regulator 102 and its associated gage are associated with panel 50.

Figure 4:
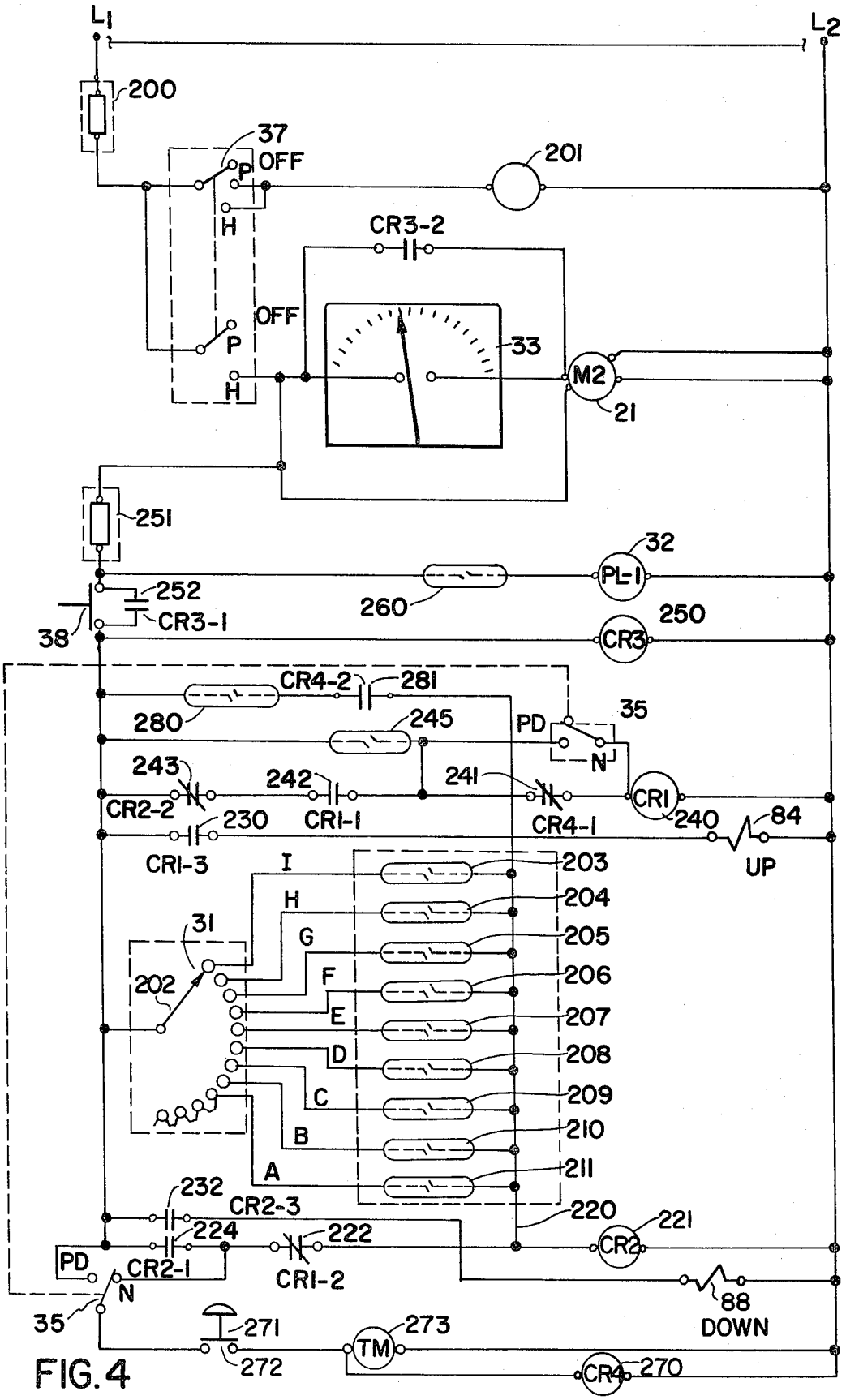
FIG. 4 is an electrical diagram useful to explain the operation of the honing machine according to this invention.

Referring to FIG. 4, there is shown an electrical schematic diagram depicting operation of the unit described above and to enable one to clearly understand the operation of the control logic 70 in conjunction with the control panel 30 and as operating to control the hydraulic and pneumatic system of FIG. 3. The entire unit is operated from the AC power lines via terminals L1 and L2 which are connected to the electronics. Thus the input power is at 110 volts 60 Hz. The input side of L1 is protected by a fuse 200.

Shown in FIG. 4 is switch 37. Switch 37 on control panel 30 is a three position switch. As seen in FIG. 4 the first position is an OFF position. The switch must be moved from the OFF position clockwise to the second position "P". In position "P" a pump motor 201 is energized. The pump motor causes the honing oil or coolant to circulate and hence before starting a honing operation one is always assured that the oil pump 201 is turned ON. The third position of switch 37 corresponds to the honing position (H). In this position the honing motor 21 of FIG. 1 is energized and the current through the motor is monitored by the meter 33. As indicated the honing motor 21 causes the honing tool 22 to rotate.

The selector switch 31 of control panel 30 is also shown in FIG. 4. The switch 31 has a selector arm 202 which is capable of selecting any one of nine reed switches 203 to 211 each of which is associated with a particular upper limit of travel as A through I. Each reed switch as 203 to 211 has one terminal connected to an associated terminal of switch 31. The other terminal of each switch is connected together via line 220 which is directed through the coil (CR2) of a relay 221. The other side of the relay 221 is coupled to one side of the power line L2. Coil 221 is also connected through a normally closed contact 222 associated with another relay and through a normally open contact 224 which is associated with relay coil 221. Solenoid 84 or the up solenoid has its coil connected via a normally open relay contact 230 to be energized by the line potential, while the coil of the down solenoid 88 is also coupled through a normally open contact 232 which contact is operated by relay coil 221, as will be explained.

A further relay coil CR1 240 is connected between the lines in a first path through a normally closed contact CR4-1 241, a normally open contact 242 which is activated by coil 240 and a normally closed contact 243 which is activated by coil 221. It is noted that each contact is further specified by the coil or relay which operates the same. Thus contact 242 is designated as CR1-1 which means that it is operated by relay coil CR1. In a similar manner, contact 241 is designated as CR4-1 and is operated by relay coil CR4 which will be described. A further path for operating relay 240 is directed through a reed switch 245 which is located at the bottom of the cylinder stroke and which represents the bottom position 80 of the honing tool as shown in FIG. 2.

A further relay coil 250 designated as CR3 is coupled directly across the line and operates upon depression of the start button 38 which is on control panel 30. If switch 37 is in the hone position, power is applied via fuse 251. Hence if switch 38 is operated, relay 250 will operate closing contact 252 across switch 38 and hence applying power to one side of relays 221, 240 and 250 or to that side of the line. The indicator lamp 32 of the control panel 30 is shown connected through a reed switch 260 which switch 260 is also located at the bottom of the cylinder 40 as is switch 245. Hence when the hone is at the bottom of the cylinder, switch 260 is closed by piston head 53 to cause lamp 32 to flash indicating this to the operator.

There is an additional circuitry shown in FIG. 4 which constitute the power dwell operation. As seen in FIG. 4 switch 35 is a two position switch and is shown in its normal position for normal hone operation. In any event when switch 35 is moved to the power dwell position, the following operation occurs: Relay coil CR1 or 240 is now connected through switch 35 to reed 245. In the power dwell position, relay coil CR4 270 is now connected to the timer push button switch 271 whose terminal 272 is coupled via the power dwell switch 35 to the other side of the line. The timing motor 273 is also connected through the timer push button 271 to the line. The upper limit for the power dwell is determined by reed 280 which is in series with a normally open contact 281 activated by coil 270 and defining the upper limit of travel during the power dwell operation. With the above circuitry in mind a description of operation of the system will now be given.

NORMAL POWER STROKE OPERATION

To start the honing cycle, switch 37 is moved from the OFF position to the pump position (P). This activates the pump 201 to cause coolant or honing oil to circulate throughout the system. Switch 37 is then moved to the hone position. In this position the honing motor 21 is energized and the honing tool 22 rotates. The beam 20 and the honing tool 22 are in the bottom position which is the down position 80 of FIG. 2. After switch 37 has been placed in the H position, the start switch 38 is now pressed. This activates relay CR3 which applies power to the power stroke circuitry. Since the beam is in its bottom position, reed 245 is closed. Therefore relay CR1 is operated and held operated through contact 242. Thus relay 240 which is CR1 is locked via contact 242 and through the normally closed contact 243 associated with relay 221 (CR2). Thus as can be seen from FIG. 4, solenoid 84 is operated via contact 230 which closes upon actuation of relay coil 240. Operation of solenoid 84 causes cylinder 83 to move the piston 53 (FIG. 2) in a direction to raise the beam up. As the beam moves upwardly, the piston head 53 closes the reed switch as 203 to 211 which represents the upper limit of travel.

In any event, as shown in FIG. 4 the arm 202 of switch 31 is connected to reed 203 which corresponds to the I position which is the lowest vertical stroke ($1\frac{1}{2}''$). Thus as soon as switch I closes, relay coil 221 (CR2) is connected through switch 203 and switch 31 to be energized.

Upon operation of coil 221 contact 243 is opened, thus releasing coil 240 and opening contact 230 to de-energize the up solenoid 84. Relay coil 221 is self-locking via contact 222 and contact 224. Contact 222 is normally closed when relay coil 240 is released. At this time solenoid 88 is activated via contact 232 which closes when coil CR2 is operated. The operation of solenoid B sends the beam in the downward direction until it reaches its maximum downward position activating reed 245 which in turn again activates coil 240 (CR1) to start the entire cycle over.

As one can see from FIG. 4, the operator may move the arm 202 of selector switch 31 of any position during operation to effectively increase or decrease the length of the vertical stroke as desired.

POWER DWELL CYCLE

During the power stroke operation as above described, the operator may decide to use the power dwell feature to thereby place the head of the honing tool at the bottom of the cylinder and allow it to remain there for a desired time as set by timer 34 on control panel 30. To do this the operator merely places switch 35 to the power dwell position (PD). The operator then presses the push button 71 associated with the timer and sets the timer motor to any desired time which for example, may be 0 to 16 seconds. By operating switch 35 and push button 271, relay coil 270 is energized via the timer push button. When relay coil 270 is energized contact 241 is opened but coil 240 is connected through switch 35 to reed 245 which defines the lower limit of power dwell operation. Upon operation of coil 270, contact 281 is also closed which places reed 280 in circuit. Reed 280 is positioned so that the honing tool will move ½" above the bottom as defined by reed 280. Hence when switch 35 is placed in the power dwell position and the timer push button is activated, the honing tool goes to the bottom as described. As the tool moves up as controlled by solenoid 84 and CR1, the reed 280 is closed by the piston and in conjunction with contact 281, energizes coil CR2 to cause the beam to again move down. This will occur for the time set on timer 273. At the end of this interval the push button 271 is automatically opened by the timer motor and relay 270 is deenergized thus opening contact 281 and closing contact 241.

Thus the honing tool will now move to the upper position selected by switch 31 even though switch 35 remains in the power dwell position. The fact that the honing tool is allowed to traverse, a small vertical distance in the power dwell position enables one to avoid glazing of the honing stones associated with the honing tool. In any event, the automatic power stroke together with the power dwell feature enables the operator to hone all types of cylinders in a simple and rapid manner. Due to the system described there is no set-up time required as the upper limit of the vertical stroke is automatically selected by means of the selector switch 31.

I claim:

1. In a honing machine of the type having a base assembly, a honing beam pivotally mounted for vertical movement on said base assembly and adapted to move up and down in said vertical plane as controlled by a cylinder having a moveable piston and coupled between the beam and said base for vertically moving the beam up or down in said vertical plane, and a rotatable honing tool assembly coupled to said beam, the combination therewith of apparatus for controlling the movement of said beam between a selectable upper limit manifesting a selectable vertical stroke, comprising:

a plurality of non-contacting sensors positioned along said cylinder and responsive to the position of said piston, to actuate when said piston is at a position corresponding to any one of a plurality of positions determined by the location of said sensor along said cylinder, and control means coupled to said sensors and operative to select any one of said sensors to cause said beam to move downwardly when said selected sensor is actuated, down sensing means responsive to said beam being in a maximum down position to provide a control signal indicative of said position, selectable operated power dwell means responsive when selected to said control signal indicative of said maximum down position, a separate sensor positioned proximate said cylinder and operative to be acutated when said power dwell means is selected to cause said sensor to be actuated when said beam moves upwardly a distance less than any distance selected by said control means and independent of said selection by said control means and selectable timing means for providing a selected timing interval when said power dwell means is selected to cause said beam to move up and down within a predetermined distance defined by said separate sensor and said down sensing means during said selected timing interval, whereby after said selected timing interval said beam continues to move up and down as selected by said control means accorded to said selected sensor.

2. The honing machine according to claim 1 wherein said plurality of non-contacting sensors comprises a plurality of magnetically operated reed switches each positioned at a different vertical location along the axis of said cylinder, with the piston head of said piston being magnetic to actuate said switches as said piston moves said beam in said vertical direction.

3. The honing machine according to claim 2 further including a multi position switch coupled to said plurality of sensors and operative to select any one of said plurality of sensors manifesting an upper limit of vertical travel.

4. The honing machine according to claim 1 where said control means further includes up control means coupled to said cylinder for moving said piston in a direction to move said beam in an up direction, down control means coupled to said cylinder for moving said cylinder in a direction to move said beam in a down direction.

5. The honing machine according to claim 1, wherein said down sensing means includes a magnetically operated reed switch.

6. The honing machine according to claim 1, wherein said separate sensor is a magnetically operated reed switch.

7. The honing machine according to claim 1, wherein said predetermined distance moved by said beam is about one-half inch.

8. The honing machine according to claim 1, wherein said selected timing interval is between 0 to 16 seconds.

* * * * *